US011628343B2

(12) United States Patent
Doty

(10) Patent No.: US 11,628,343 B2
(45) Date of Patent: Apr. 18, 2023

(54) TETHERED RING TOSS GAME APPARATUS

(71) Applicant: Tom Doty, Rolesville, NC (US)

(72) Inventor: Tom Doty, Rolesville, NC (US)

( * ) Notice: Subject to any disclaimer, the term of this patent is extended or adjusted under 35 U.S.C. 154(b) by 44 days.

(21) Appl. No.: 17/443,116

(22) Filed: Jul. 21, 2021

(65) Prior Publication Data

US 2022/0080276 A1 Mar. 17, 2022

Related U.S. Application Data

(60) Provisional application No. 63/078,032, filed on Sep. 14, 2020.

(51) Int. Cl.

| | |
|---|---|
| ***A63B 67/10*** | (2006.01) |
| ***A63B 71/06*** | (2006.01) |
| ***A63B 67/06*** | (2006.01) |

(52) U.S. Cl.

CPC ..... *A63B 67/10* (2013.01); *A63B 67/06* (2013.01); *A63B 71/0672* (2013.01); *A63B 2067/063* (2013.01)

(58) Field of Classification Search

CPC ..... A63B 67/10; A63B 2067/063; A63F 9/02; A63F 9/0208

See application file for complete search history.

(56) References Cited

U.S. PATENT DOCUMENTS

| | | | | |
|---|---|---|---|---|
| 292,899 | A | 2/1884 | Davies | |
| 469,928 | A * | 3/1892 | Blinn | A63F 9/02 273/332 |
| 1,052,907 | A | 2/1913 | Fergusson et al. | |
| 1,398,511 | A * | 11/1921 | Hanrath | A63B 67/10 273/332 |
| 1,519,936 | A * | 12/1924 | Schneider | A63B 67/205 473/514 |
| 2,950,917 | A | 8/1960 | Albert | |
| 3,009,702 | A | 11/1961 | Albert | |
| 3,520,535 | A | 7/1970 | Dubbs et al. | |
| 4,120,498 | A | 10/1978 | Mutschler et al. | |
| 4,564,200 | A | 1/1986 | Loring et al. | |
| 5,171,019 | A | 12/1992 | Arnette | |
| 7,766,337 | B2 * | 8/2010 | Constantine | A63B 67/06 273/317.1 |
| 7,896,349 | B2 | 3/2011 | Pershin et al. | |
| 8,011,664 | B2 | 9/2011 | Hilbert, Jr. et al. | |
| 10,981,041 | B2 | 4/2021 | McGetrick | |
| 2010/0311024 | A1 * | 12/2010 | Schenck | A63B 21/1681 434/258 |
| 2014/0001705 | A1 | 1/2014 | Goebel | |

* cited by examiner

*Primary Examiner* — Laura Davison

(74) *Attorney, Agent, or Firm* — PatentFile, LLC; Bradley C. Fach; Steven R. Kick

(57) ABSTRACT

A tethered ring toss game apparatus is provided. In some embodiments, the apparatus may include a target device having a target body, a first bar target, a second bar target, a first hook target, and a second hook target. The first bar target and second bar target may be positioned on opposite sides of the target body, and the first hook target and second hook target may be positioned on opposite sides of the target body. A ring having a ring aperture may be coupled to a first end of a flexible tether, and a second end of the flexible tether may be positioned between 28 and 38 degrees above the target device. The flexible tether may have a length that enables the ring aperture of the ring to be alternatively positioned around each of the first bar target, second bar target, first hook target, and second hook target.

17 Claims, 13 Drawing Sheets

TETHERED RING TOSS GAME APPARATUS

CROSS REFERENCE TO RELATED APPLICATIONS

This application claims priority to and the benefit of the filing date of U.S. Provisional Application No. 63/078,032, filed on Sep. 14, 2020, entitled "Multiplayer Tethered Ring Toss Game using Multiple Rings and Targets", which is hereby incorporated by reference in its entirety.

FIELD OF THE INVENTION

This patent specification relates to the field of tethered ring gaming. More specifically, this patent specification relates to a tethered ring gaming apparatus having a number of tethered rings which may be engaged to a number of targets which enables "head-to-head" competition and other types of game play.

BACKGROUND

Games that use a tethered ring and target are commonly known as hook and ring games. These hook and ring games have been challenging and amusing the likes of young and old for generations have changed little over time. Typically, these games consist of a single tethered ring attached to a ceiling swung towards a single hook target. These games claim that they are intended for multiple players, however to compete players must take turns using the same tethered ring to try engage the same single hook target, during play each player takes a predetermined number of swings (usually 5), after which a score is determined based on how many times their ring caught the hook. Some other tethered ring toss games that may have multiple hooks differing in size or shape and arranged to vary the degree of difficulty also requires that competing players take turns using the same ring and are played similarly to the game described above except that scoring might take into consideration the point values assigned to the different hooks. There is at least one other hook and ring game that has multiple tethered rings that can be played by multiple players where players use their own rings, however each player's ring is tethered to a different pivot point with each player having their own assigned target. Players during these games can compete at the same time with the winner being the player who is first to "catch" their ring on their target or the player who catches their ring the most times during a certain period of time.

Current and past hook and ring games although challenging could be said to be more of an amusement game than a game of skill or sport, these games all lack the attributes to be a competitive scoring game of skill for multiple players to compete "head-to-head". Therefore, it would be desirable to have a multiplayer tethered ring toss target game where players interactively compete to occupy different targets at the same time to score points or compete to occupy the same target at the same time to cancel the scoring points of their opponent. It would also be desirable to have a game where multiple tethered ring devices attached to a single overhead pivot point can be manually propelled towards multiple targets where an objective could be to either engage your ring onto a target or bring about the removal of an opponent's ring from a target. Also desirable is a tethered ring toss target game where during a game round a player can have their tethered ring engage with targets different than the tethered rings of their opponent which can result in points awarded to each player. Furthermore, it is desirable to have a tethered toss target game with a scoreboard that is conveniently located near the targets so that it can be utilized to update a player's point score after each game round.

BRIEF SUMMARY OF THE INVENTION

A tethered ring toss game apparatus is provided. In some embodiments, the apparatus may include a target device having a target body, a first bar target, a second bar target, a first hook target, and a second hook target. The first bar target and second bar target may be positioned on opposite sides of the target body, and the first hook target and second hook target may be positioned on opposite sides of the target body. A ring having a ring aperture may be coupled to a first end of a flexible tether, and a second end of the flexible tether may be positioned between 28 and 48 degrees above the target device. The flexible tether may have a length that enables the ring aperture of the ring to be alternatively positioned around each of the first bar target, second bar target, first hook target, and second hook target.

In further embodiments, the apparatus may include a target device having a target body, a first bar target, a second bar target, a first hook target, and a second hook target. The first bar target and second bar target may be positioned on opposite sides of the target body, and the first hook target and second hook target may be positioned on opposite sides of the target body. The first hook target and second hook target may be planar in shape, and the first hook target and second hook target may be positioned in a vertical plane. The first bar target may have a first proximal section and the second bar target may have a second proximal section, and both the first proximal section and second proximal section may be positioned in the vertical plane. The first bar target may also have a first distal section and the second bar target may also have a second distal section, and both the first distal section and second distal section may extend out of the vertical plane. A ring having a ring aperture may be coupled to a first end of a flexible tether, and a second end of the flexible tether may be coupled to a tether attachment device that may be positioned between 28 and 48 degrees above the target device. The flexible tether may have a length that enables the ring aperture of the ring to be alternatively positioned around each of the first bar target, second bar target, first hook target, and second hook target.

Numerous objects, features and advantages of the present invention will be readily apparent to those of ordinary skill in the art. Some example objects of the present invention are listed below.

One object of the present invention is to provide a multiplayer tethered ring toss game where multiple tethered rings attached to the same overhead pivot point, each using their own flexible tether are manually propelled towards multiple targets where the primary objective is to engage one's tethered ring on to a target or bring about the removal of another tethered ring from a target.

Another object is to provide a tethered ring toss multiplayer interactive game where players compete "head-to-head" to have their tethered rings occupy different targets at the same time to score points or to occupy the same target at the same time to cancel the scoring of their competing player.

Another object is to provide a game apparatus having an easy means to change the number of tethered ring devices to facilitate the desired number of players and or version of the game play while maintaining multiple tethers horizontally separated to improve their swinging motions and reduce tangling.

Another object is to provide a game apparatus that includes a scoreboard located near the targets that can be utilized to update a player's point score after each game play round.

Another object is to provide a game apparatus having the ability to attach accessories such as an optional tether pole attachment device that can be placed on the game apparatus to facilitate the addition of a tether pole to create a boom-like cantilever arm that provides an overhead pivot connection points for tethered rings.

Another object is to provide a game apparatus that includes an optional game backboard-wall protector that functions to deflect a tethered ring in motion back down towards the game apparatus that both increases the chance of the deflected ring to engage a target device and prevents deflected ring from damaging walls or vertical surface areas directly adjacent to game apparatus.

Another object is to provide a game apparatus having a means for a tether to safely separate and detach to protect the game apparatus from damage and persons from injury if someone inadvertently walks into a tether while it is attached onto a target. Another safety feature provides a means to store attached tethered rings when not in use at a height above floor level over the head heights of most people to safely walk in front of a game apparatus.

The present invention in a preferred embodiment relates to a tethered ring toss target game where a ring or multiple rings secured to a flexible tether that are attached to an overhead pivot point can be manually propelled to releaseably engage a target device in the certain following ways; 1) a tethered ring can encircle and catch onto a target hook, 2) a tethered ring can encircle and slide onto a target slide bar, 3) a tethered ring can hang by its tether over a target slide bar, 4) a tethered ring can replicate the engagement of an opponents tethered ring and occupy the same target. 5) a tethered ring can cause the removal of an opponents tethered ring from a target, 6) a tethered ring can occupy a target in such a way that blocks or impedes another tethered ring's ability to successfully engage a target.

The following generally describes the game-play in a preferred embodiment of the present invention; two players each holding their tethered ring stand next to each other at the distance opposite from the game apparatus that pulls their tethers taut, enabling them to easily swing their tethered rings towards the targets on the game apparatus. The floor can be marked to identify where each player stands during game play; one mark is centered and in direct line to the game apparatus targets where a player stands when it's their turn to "swing", two other marks are to the left and to the right of the center position and are where players stand when not their turn and where they 'step back to' each time their turn ends. At the end of each game round the players can retrieve any tethered rings that are still engaged on the target devices and update their scores on the game scoreboard.

BRIEF DESCRIPTION OF THE DRAWINGS

Some embodiments of the present invention are illustrated as an example and are not limited by the figures of the accompanying drawings, in which like references may indicate similar elements and in which.

DETAILED DESCRIPTION OF THE INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

Figure 1:
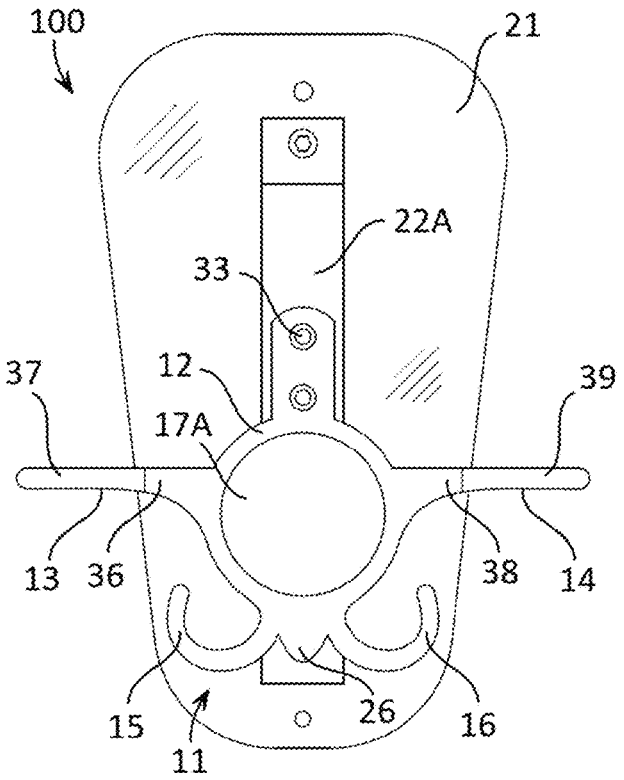
FIG. 1 depicts a front elevation view of an example of a tethered ring toss game apparatus according to various embodiments described herein.

For purposes of description herein, the terms "upper," "lower," "left," "right," "rear," "front," "side," "vertical," "horizontal," and derivatives thereof shall relate to the invention as oriented in FIG. 1. However, one will understand that the invention may assume various alternative orientations and step sequences, except where expressly specified to the contrary. Therefore, the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Although the terms "first," "second," etc. are used herein to describe various elements, these elements should not be limited by these terms. These terms are only used to distinguish one element from another element. For example, the first element may be designated as the second element, and the second element may be likewise designated as the first element without departing from the scope of the invention.

As used in this application, the term "about" or "approximately" refers to a range of values within plus or minus 10% of the specified number. Additionally, as used in this application, the term "substantially" means that the actual value is within about 10% of the actual desired value, particularly within about 5% of the actual desired value and especially within about 1% of the actual desired value of any variable, element or limit set forth herein.

A new tethered ring toss game apparatus is discussed herein. In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

The present invention will now be described by example and through referencing the appended figures representing preferred and alternative embodiments. FIGS. 1-9, 17 and 18 illustrate examples of a tethered ring toss game apparatus ("the apparatus") 100 according to various embodiments. In some embodiments, the apparatus 100 may comprise target device 11 having a target body 12, a first bar target 13, a second bar target 14, a first hook target 15, and a second hook target 16. The first bar target 13 and second bar target 14 may be positioned on opposite sides of the target body 12, and the first hook target 15 and second hook target 16 may also be positioned on opposite sides of the target body 12. Preferably, the first hook target 15 and second hook target 16 may be planar in shape, and the first hook target 15 and second hook target 16 may also be positioned in a vertical plane 71. The apparatus 100 may also include a ring 31 having a ring aperture 32, and a tether attachment device 41 configured to be coupled above the target device 11 so that the tether attachment device 41 may be positioned approximately 38 degrees above the target device 11. The ring 31 may be coupled to a first end 52 of a flexible tether 51, and the tether attachment device 41 may be coupled to a second end 53 of the flexible tether 51. The flexible tether 51 may comprise a length that enables the ring aperture 32 of the ring 31 to be alternatively positioned around each of the first bar target 13, second bar target 14, first hook target 15, and second hook target 16.

In some embodiments, the apparatus 100 may comprise a game base board 21 that may be configured in any shape and size and may provide a solid support that may be coupled to a wall 202, column, or other object to which the target device 11 is desired to be positioned. A game base board 21 may be made from wood, metal, plastic, or any other suitable rigid material.

In preferred embodiments, the apparatus 100 may comprise a game block device 22 (FIGS. 17 and 18), 22A (FIGS. 1-3), 22B (FIGS. 4 and 5), 22C (FIGS. 6 and 7), 22D (FIGS. 8 and 9) to which a target device 11 may be coupled. It should be understood that the suffixes of "A", "B", "C", etc., designate different embodiments of the game block device 22 so that the game block devices 22A, 22B, 22C, 22D, etc., read on the teachings of game block device 22. Generally, a game block device 22 may be configured to separate a target device 11 that is coupled to a game block device 22 from the object or surface that is to support the target device 11 and game block device 22 above a floor 201 or other surface so that rings have room to move behind the target device 11 in the space provided by a game block device 22.

In some embodiments, a game block device 22 may comprise one or more mounting surfaces 23A, 23B, 23C, 23D, 23E, 23F, to which one or more objects may be placed in contact with and/or coupled. For example, and as shown in the embodiments in FIGS. 5 and 7, a game block device 22 may comprise a vertical mounting surface 23C which may be placed in contact with and/or coupled to a vertical object, such as a wall 202, column, etc., that may support the game block device 22 above a floor 201 or other surface. As another example, and as shown in the embodiments in FIG. 9, a game block device 22D may comprise a vertical mounting surface 23C to which a game and pole bracket 25, 25A, 25B, may be coupled, and the game and pole bracket 25, 25A, 25B, may comprise a bracket mounting plate 64 which may be placed in contact with and/or coupled to a vertical object, such as a wall 202, column, etc., that may support the game block device 22 above a floor 201 or other surface.

A game block device 22 may be made from or may comprise wood, plastic, aluminum or similar performing material. A game block device 22 may be configured in any size and shape to accept the attachment of a target device 11 in a specific position to make it possible and likely that the arc path 79 of a swinging overhead tethered ring 31 can engage the targets 13, 14, 15, 16, of the target device 11.

In some embodiments, and as perhaps best shown in FIGS. 1, 4, 6, and 8, a target device 11 may comprise one or more bar targets 13, 14, and/or one or more hook targets 15, 16. In preferred embodiments, a target device 11 may have a first bar target 13, a second bar target 14, a first hook target 15, and a second hook target 16 that may be coupled to a target body 12. Elements of a target device 11, such as targets 13, 14, 15, 16, and target body 12, may be made or for may comprise metal, plastic, wood, or any other substantially rigid material. During game-play and for purpose of determining the scoring of points the hook targets 15, 16, of target device 11 may be referred to as the "left hook" and the "right hook" and the bar targets 13, 14, may be referred to as the "left slider bar" and the "right slider bar" as they pertain to their orientation to a player that is facing the target device 11.

A target body 12 may be configured in any size and shape so that the target body 12 may form a structure to which targets 13, 14, 15, 16, may be coupled, and optionally to which a scoreboard device 17 may be coupled. In some embodiments, a first bar target 13 and second bar target 14 may be positioned on opposite sides of the target body 12 so that the bar targets 13, 14, may generally extend away from the target body 12 in opposing directions (relative to each other). In further embodiments, a first hook target 15 and a second hook target 16 may also be positioned on opposite sides of the target body 12 so that the hook targets 15, 16, may generally extend away from the target body 12 in opposing directions (relative to each other). In further embodiments, a first bar target 13 may be positioned above a first hook target 15, and a second bar target 14 may be positioned above a second hook target 16.

In preferred embodiments, a target body 12 may comprise a body projection 26 which may comprise a projection that extends away from the target body 12. Generally, a body projection 26 may be positioned and shaped to influence the movement of a ring 31, 31A, 31B, after it impacts the body projection 26, such as to make it easier or harder for a ring 31, 31A, 31B, to engage a target 13, 14, 15, 16. A body projection 26 may be configured in any size and shape, such as a blunted triangular shape as perhaps best shown in FIGS. 1, 4, 6, and 8. Preferably, a body projection 26 may be positioned between a first hook target 15 and a second hook target 16 so that a swinging ring 31, 31A, 31B, striking just left or right of the body projection 26 "flips" the ring 31, 31A, 31B, on to a hook target 15, 16, thus increasing the chances of a player 251, 252, engaging their ring 31, 31A, 31B, on to a hook target 15, 16.

Figure 2:
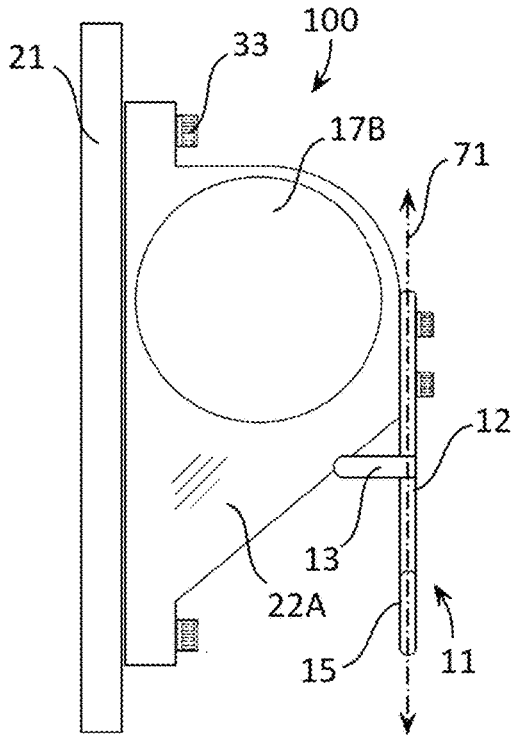
FIG. 2 illustrates a side elevation view of the example of the tethered ring toss game apparatus of FIG. 1.
Figure 3:
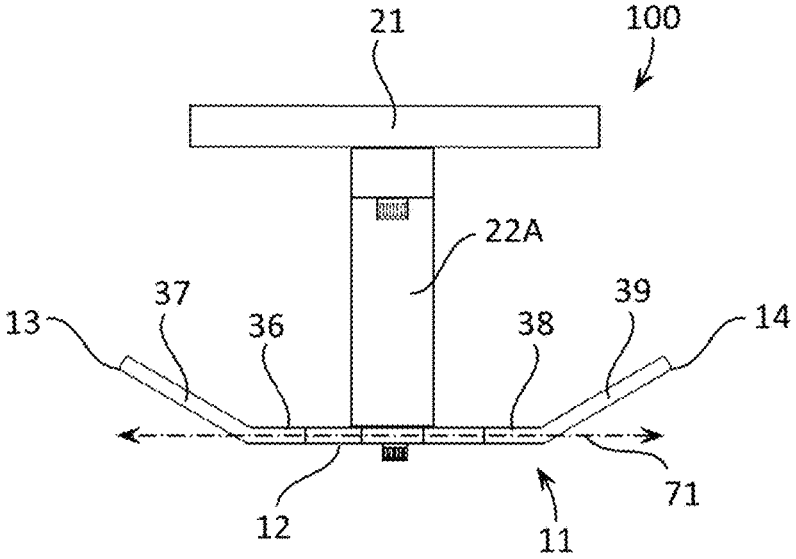
FIG. 3 shows a top plan view of the example of the tethered ring toss game apparatus of FIGS. 1 and 2.

Hook targets 15, 16, may be configured in any size and shape, but having a curved or bent back at an angle portion for catching hold of or hanging things on, such as a ring 31. Generally, a hook target 15, 16, may have a curved or bent back at an angle portion which may be positioned through a ring aperture 32 of a ring 31. Preferably, the hook targets 15, 16, may be planar in shape so that the hooked portion of each hook target 15, 16, may be positioned in a plane, and more preferably the hook targets 15, 16, may be positioned in the same plane, as a vertical plane 71 (FIGS. 2 and 3).

Bar targets 13, 14, may also be configured in any size and shape, but having one or more elongated portions for catching hold of or hanging things on, such as a ring 31. Generally, a bar target 13, 14, may have one or more slender, elongated portions which may be positioned through a ring aperture 32 of a ring 31. In some embodiments, a bar 13, 14, may comprise two or more portions which may be planar, angled, curved, or otherwise shaped. For example, a first bar target 13 may comprise a first proximal section 36 and a second bar target 14 may comprise a second proximal section 38, and both the first proximal section 36 and second proximal section 38 may be positioned in the vertical plane 71. As another example, a first bar target 13 may comprise a first distal section 37 and a second bar target 14 may comprise a second distal section 39, and both the first distal section 37 and second distal section 39 may extend out of the vertical plane 71 as perhaps best shown in FIG. 3.

Figure 5:
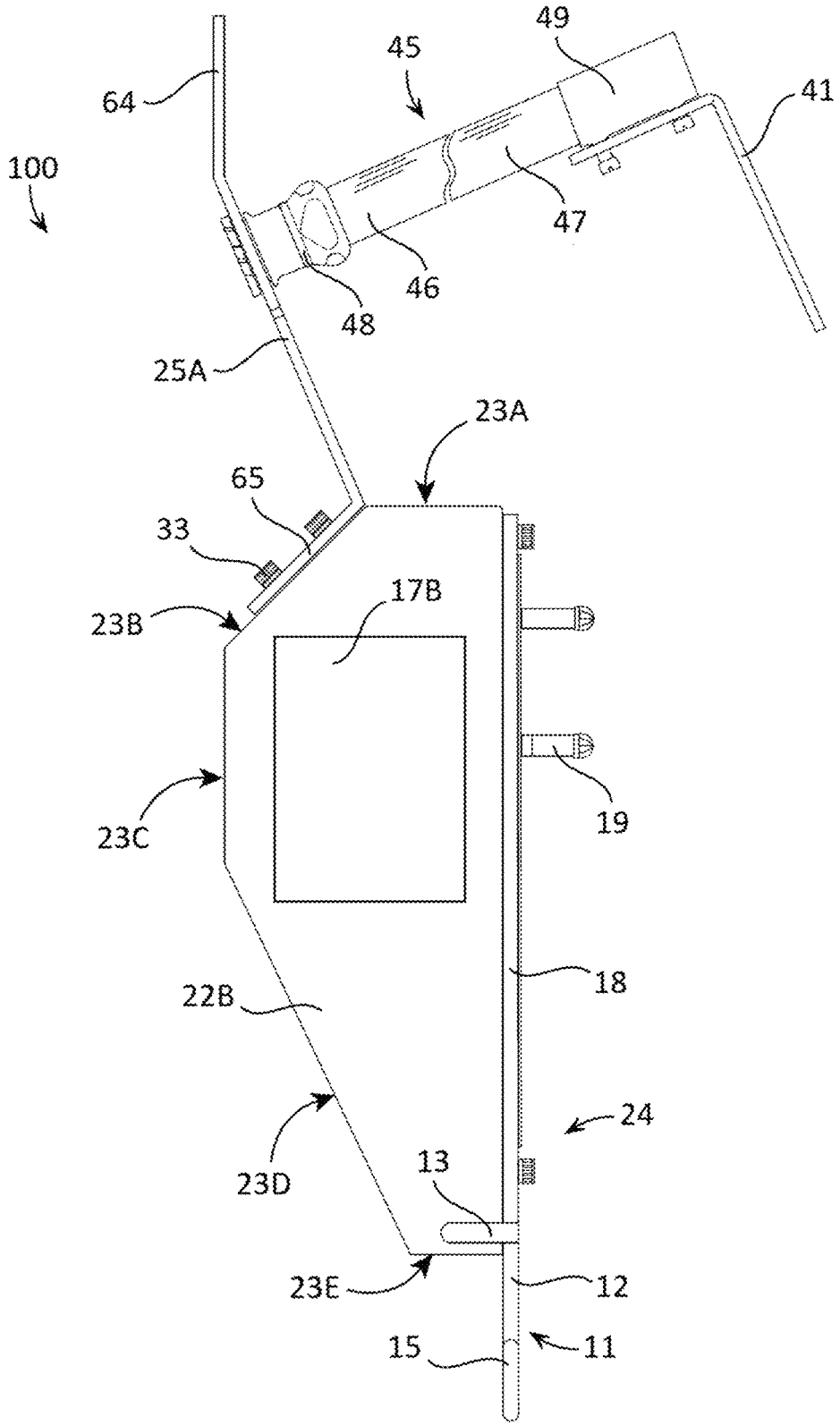
FIG. 5 illustrates a side elevation view of the example of the tethered ring toss game apparatus of FIG. 4.

Any suitable coupling device or method may be used to couple a target device 11 to a game block device 22. For example, one or more fasteners 33, such as appropriately sized galvanized, stainless or zinc plated steel bolts and threaded inserts. Optionally, the apparatus 100 may comprise a graphic label 17A that may be positioned on the front of target body 12, and graphic label 17 may be a printed label or graphics can be painted directly on the target device 11 and it can show product name and other game information. Optionally, and as shown in FIG. 5 the apparatus 100 may comprise a game block graphics label 17B that may be located on one side or both sides of game block device 22, this graphics label(s) 17B may be a printed label or its graphics can be painted directly on game block device 22 and it can show product name and other game information and instructions on how to play the game.

In some embodiments, and as best shown in FIGS. 4-9, the apparatus 100 may comprise a scoreboard device 18. In preferred embodiments, a scoreboard device 18 may be coupled to a target device 11, and more preferably coupled to the target body 12, such as by being integrally formed, molded, machined, welded, etc. A scoreboard device 18 may be made from or may comprise metal, plastic, wood, slate, a dry-erase surface, or any other structural material or device. In preferred embodiments, a scoreboard device 18 may be made from or may comprise a magnetic material which may enable one or more score markers 19 to be magnetically coupled or engaged to the scoreboard device 18. Score markers 19 may be configured in any shape and size and may preferably comprise a magnetic material that may be magnetically engaged with magnetic material of a scoreboard device 18. A scoreboard device 18 may be attached to game block device 22 using one or more fasteners 33, such as appropriately sized galvanized, stainless or zinc plated steel bolts that may be coupled to appropriate threaded inserts of game block device 22, or with any other suitable coupling method.

In some embodiments, the apparatus 100 may comprise one or more flexible tethers 51 having a first end 52 and a second end 53 in which a ring 31 may be coupled to the first end 52 and in which the second end 53 may be coupled to an object so that it may be positioned between 25 and 50 degrees, and more preferably approximately 38 degrees, above the target device 11. Optionally, a second end 53 may be coupled to a tether pole 45 and/or tether attachment device 41, ceiling 203, or other structural object so that it may be positioned between 28 and 48 degrees, and more preferably approximately 38 degrees, above the target device 11. In preferred embodiments, a second end of a flexible tether 51 may be removably coupled to the tether attachment device 41. A flexible tether 51 may be made from a length of rope, twine, yarn, paracord, braided rope or cord made from polyester, nylon, polypropylene etc., or other relatively thin and elongate material, and each flexible tether 51 may comprise a length that enables the ring aperture 32 of the ring 31 that it is coupled thereto to be alternatively positioned around each of the first bar target 13, second bar target 14, first hook target 15, and second hook target 16.

Figure 15:
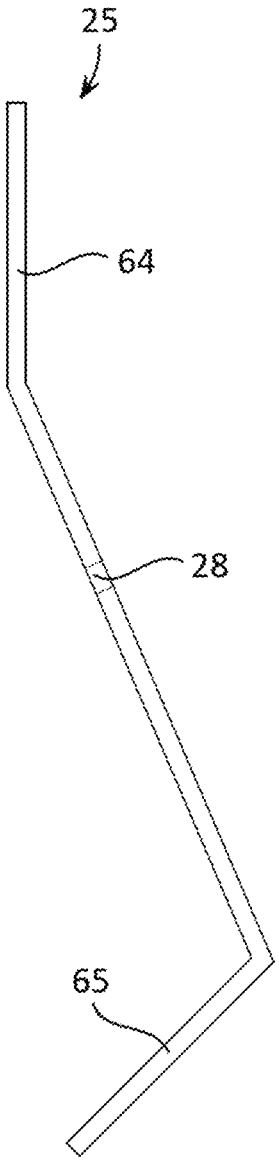
FIG. 15 shows a side elevation view of an example of a game and pole bracket according to various embodiments described herein.

Again, with reference to FIG. 15, in some embodiments, a flexible tether 51 may comprise two flexible tether sections 57, 58, that may be removably coupled together via a safety breakaway cord connector device 54, with the first end portion of the first section 57 of the flexible tether 51 secured to a ring 31, preferably using a tethered ring locking bead device 55 or other coupling method, with its second end portion attached to one half of a Safety breakaway cord connector device 54. The first end of the second section 58 of the flexible tether 51 may be attached to the other remaining half of a safety breakaway cord connector device 54. In some embodiments, the second end of the second section 58 of the flexible tether 51 may be passed through a hole of tether end bead device 56, and the end of the tether section may then be knotted to secure tether end bead device 56 to tether second end 53. In preferred embodiments, the second end 53 of the completed tethered ring device assembly 35 (comprising a ring 31 coupled to a flexible tether 51) can then be attached to an overhead tether attachment device 41 by passing tether end bead device 56 thru the round shaped bead aperture 42 and then over and down into one of four slot cutouts 43 of overhead tether attachment device 41 as perhaps best shown in FIGS. 11 and 12. Safety breakaway cord connector device 54 may comprise any removably coupling device, such as a typical plastic snap buckle or clasp commonly used in bracelets or necklaces, enabling it to act as a safety device and will separate tether sections 57, 58, to protect the game apparatus 100 from damage and persons from injury such as if someone inadvertently walks into a tether 51 while is hooked or attached onto a target 13, 14, 15, 16. In some embodiments, tethered ring locking bead device 55 may be used to secure a ring 31 to its tether 51 and can be used to accurately adjust the overall length of the tethered ring assembly 35. In other embodiments, any other suitable coupling method may be used to couple a second end 53 of a flexible tether 51 to a tether attachment device 41, ceiling 203, etc.

Figure 16:
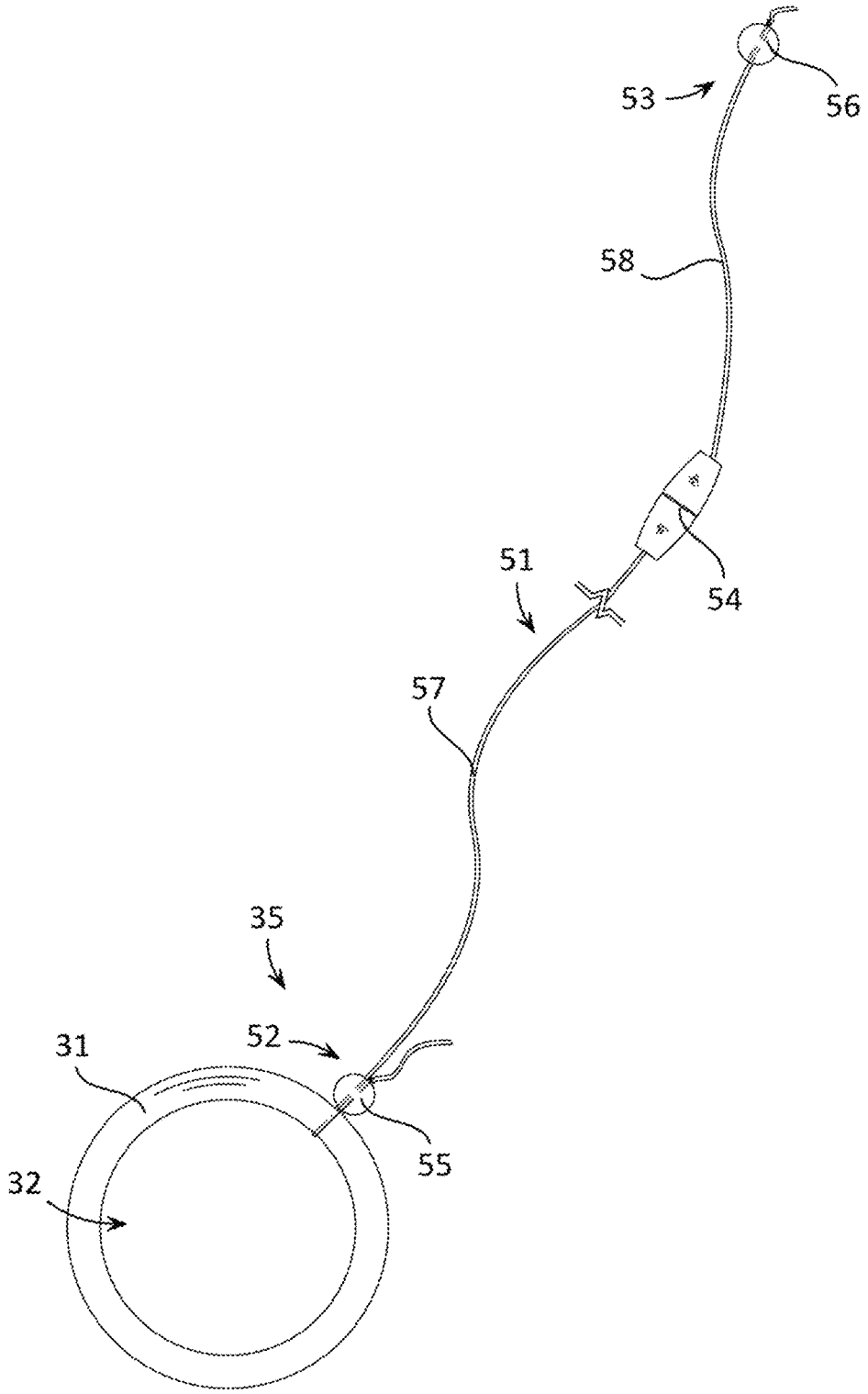
FIG. 16 depicts a perspective view of an example of a tethered ring device assembly according to various embodiments described herein.

With reference to FIG. 16, a tethered ring device assembly 35 is shown comprising a ring 31 and a flexible tether 51. Optionally, a flexible tether 51 may comprise a safety breakaway tether connector device 54, a tethered ring locking bead device 55, and tether end bead device 56. In some embodiments, ring 31 may comprise an annular shape, such as a continuous circular ring as shown in FIG. 15. In further embodiments, ring 31 may be configured in any other desirable form shapes such as squares, ovals or triangles. Ring 31 may be made of or may comprise galvanized, stainless or zinc plated steel, brass or other similar performing materials.

Figure 11:
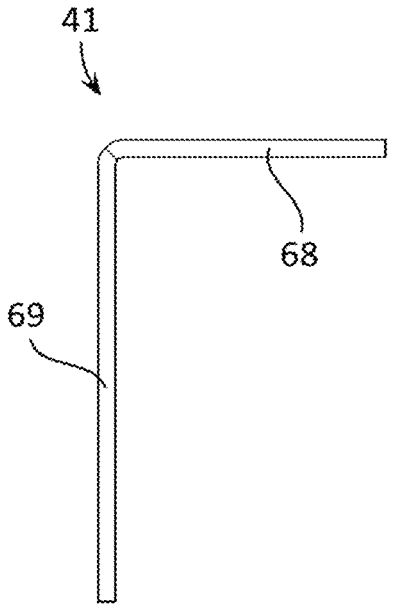
FIG. 11 illustrates a side elevation view of an example of a tether attachment device according to various embodiments described herein.
Figure 12:
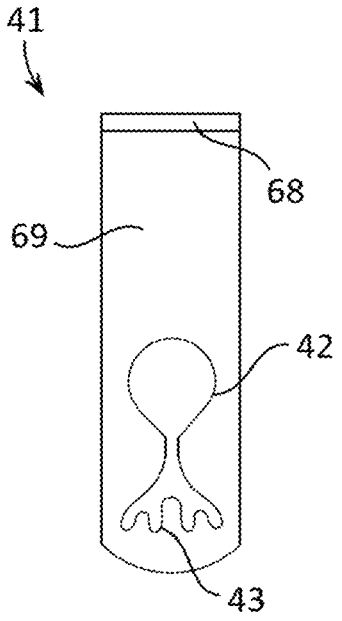
FIG. 12 shows a front elevation view of the example tether attachment device of FIG. 11.
Figure 13:
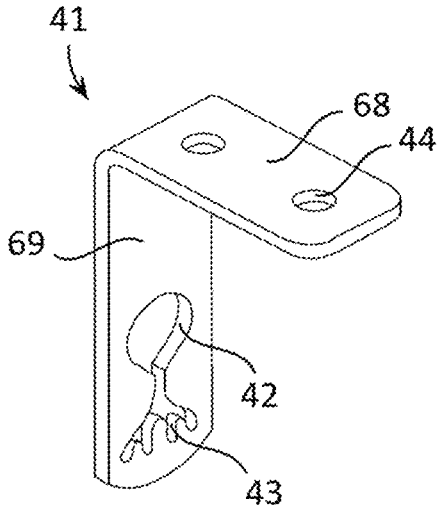
FIG. 13 depicts a top perspective view of the example tether attachment device of FIGS. 11 and 12.

With reference to FIGS. 11-13, an example of a tether attachment device 41 is shown that may be used to receive the attachment of one or more, such as multiple, tethered rings 31. A tether attachment device 41 may be made from or may comprise galvanized, stainless or zinc plated steel, aluminum or any other similar performing material. A tether attachment device 41 may be configured in any shape and size. In some embodiments, a tether attachment device 41 may be shaped suchlike a 90 degree angle bracket with one bracket leg 68 having one or more attachment apertures 44 that may provide for mounting the tether attachment device 41 to an overhead ceiling 203, to pole distal attachment device 49, etc., and with other bracket leg 69 having a uniquely shaped cut out comprising of a bead aperture 42 shaped as round shaped hole and slot cutouts 43 shaped as slotted cutout shapes to accommodate the attachment of one or more second ends 53 of a flexible tethers 51. Preferably, a tether attachment device 41 may comprise four (4) slot cutouts 43 arranged with two slot cutouts 43 to the left of center and two slot cutouts 43 to the right of center, each shaped and angled to maintain in place multiple second ends 53 of flexible tethers 51 horizontally separated from each other during game play.

In some embodiments, the apparatus 100 may comprise a tether attachment device 41 configured to be coupled above the target device 11 so that the tether attachment device 41 may be positioned between approximately 28 and 48 degrees, and more preferably approximately 38 degrees, above the target device 11. In some embodiments, a tether attachment device 41 may be coupled to a ceiling 203 or other overhead structure in order to position the tether attachment device 41 above the target device 11. In further embodiments, a tether attachment device 41 may be coupled to a tether pole 45. The ring 31 may be coupled to a first end 52 of a flexible tether 51, and the tether attachment device 41 may be coupled to a second end 53 of the flexible tether 51.

In some embodiments, a second end 53 of one or more flexible tethers 51 may be removably coupled to the tether attachment device. Preferably, a tether attachment device 41 may comprise a bead aperture 42 that may be in communication with one or more slot cutouts 43. Generally, a bead aperture 42 may be sized larger than a tether end bead device 56, and slot cutouts 43 may be sized to be smaller than a tether end bead device 56. Optionally, a portion of the second end 53 of a flexible tether 51 may be positioned through the bead aperture 42 and/or slot cutouts 43 in order to couple the second end 53 to the tether attachment device 41. Preferably, the second end 53 of the completed tethered ring device assembly 35 may be removably coupled to an overhead tether attachment device 41 by passing tether end bead device 56 thru the round shaped bead aperture 42 and then over and down into one of four slot cutouts 43 of overhead tether attachment device 41 as perhaps best shown in FIGS. 11 and 12.

In some embodiments, the apparatus 100 may comprise a tether pole 45 which may be coupled to an element of the apparatus 100, such as to a game and pole bracket 25, 25A, 25B. A tether pole 45 may comprise a proximal end 46 and an opposing distal end 47. A second end 53 of a flexible tether 51 may be coupled to the distal end 47, preferably via a tether attachment device 41, and the proximal end 46 may be coupled to another object, such as to a wall 202, game block device 22, etc., preferably via a game and pole bracket 25, 25A, 25B.

A tether pole 45 may be configured in any size and shape which may enable the tether pole 45 to position a second end 53 of one or more flexible tethers 51 to be between 28 and 48 degrees above the target device 11. For example, a tether pole 45 may comprise a single length pole such as a standard 60 inch length of electric metallic tube (EMT) conduit or other length pole made out of wood, composite wood, plastic, aluminum or similar performing material. As another example, a tether pole 45 may comprise an adjustable length, such as by having two or more sections that may be removably coupled together and/or coupled together in a telescoping manner. Generally, a tether pole 45 when coupled to an object, such as to a game block device 22, game and pole bracket 25, 25A, 25B, etc., creates a boom-like cantilever arm providing an overhead pivot point connection location for coupling the second end 53 of one or more flexible tethers 51.

In some embodiments, a second end 53 of one or more flexible tethers 51 may be coupled directly to a tether pole 45. In further embodiments, game and pole bracket 25, 25A, 25B, may comprise a large hole sized to accept the mounting of optional pole proximal attachment device 48 that may be used for the insertion and coupling of a proximal end 46 of a tether pole 45. Optionally, a pole distal attachment device 49 may be coupled to distal end 47 of tether pole 45 which may be used for the attachment of overhead tether attachment device 41 as shown in referenced drawings. Pole proximal attachment device 48 may comprise a standard electric metallic tube (EMT) compression connector conduit fitting or any other coupling device or method, and a pole distal attachment device 49 may comprise a standard electric metallic tube (EMT) set screw coupling conduit fitting or any other coupling device or method.

In some embodiments, the apparatus 100 may comprise a game and pole bracket 25, 25A, 25B. Optionally, a game and pole bracket 25, 25A, 25B, may be configured to be coupled to and support a tether pole 45, and/or a game and pole bracket 25, 25A, 25B, may be configured to be placed in contact with and/or coupled to a vertical object, such as a wall 202, column, etc., that may support the game block device 22 above a floor 201 or other surface. A game and pole bracket 25, 25A, 25B, may be configured in any size and shape, and a game and pole bracket 25, 25A, 25B, may be made from or may comprise metal, wood, plastic, or any other suitable rigid material.

Figure 7:
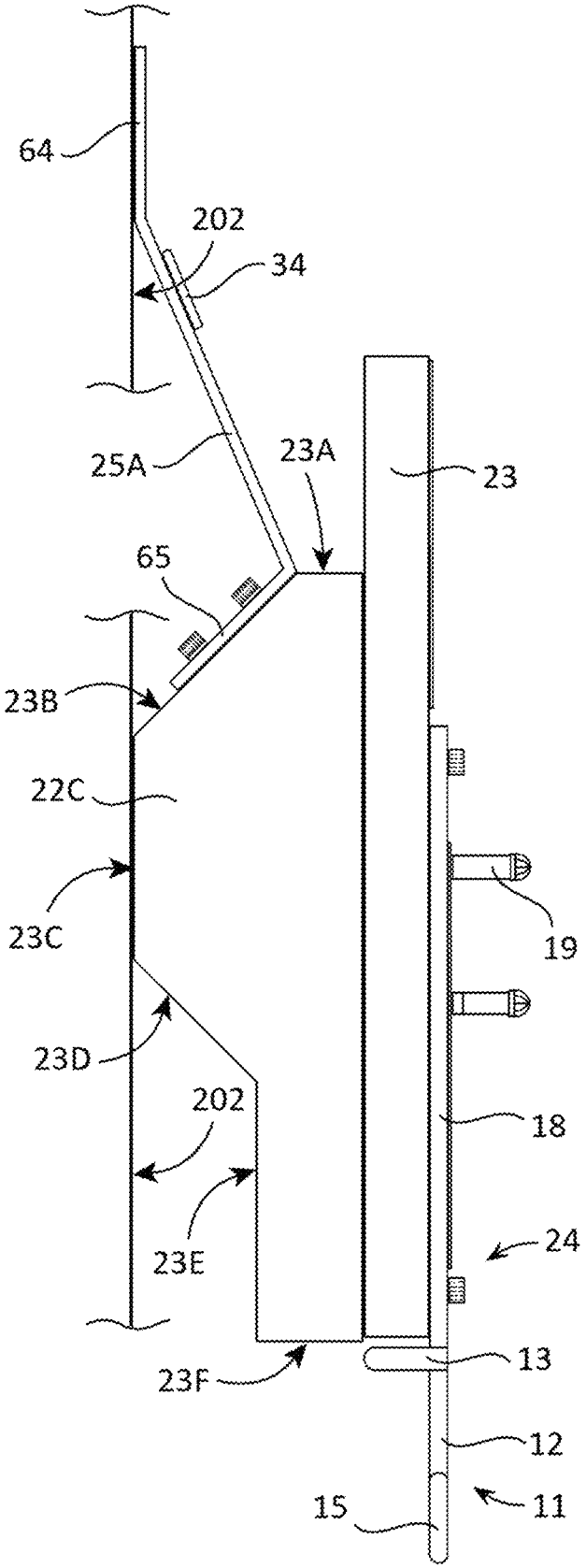
FIG. 7 depicts a side elevation view of the example of the tethered ring toss game apparatus of FIG. 6.
Figure 9:
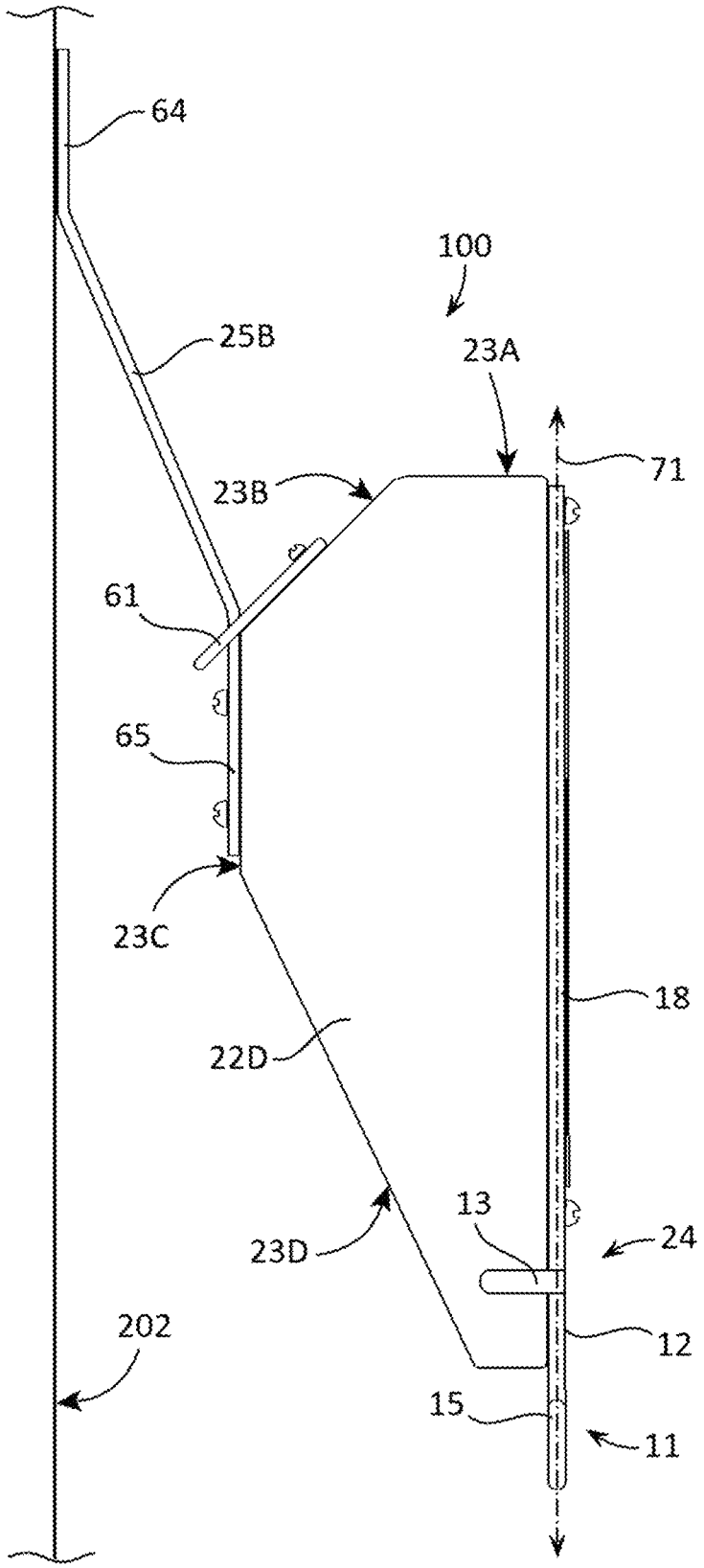
FIG. 9 shows a side elevation view of the example of the tethered ring toss game apparatus of FIG. 8.

In some embodiments, a game and pole bracket 25, 25A, 25B, may comprise a block mounting plate 65 which may be coupled to a mounting surface 23B, 23C, of a game block device 22, and a bracket mounting plate 64 which may be coupled to a vertical object, such as a wall 202, column, etc. In some embodiments and as best shown in FIG. 7, a game and pole bracket 25A may be configured with a mounting plate 65 which may be angled to allow the mounting plate 65 to be coupled to a mounting surface 23B of a game block device 22 while allowing another mounting surface 23C of the game block device 22C to also contact a vertical object, such as a wall 202, that the bracket mounting plate 64 is coupled to. In further embodiments and as best shown in FIG. 9, a game and pole bracket 25B may be configured with a mounting plate 65 which may be angled to allow the mounting plate 65 to be coupled to a mounting surface 23C of a game block device 22 while separating the game block device 22D from the vertical object, such as a wall 202, that the bracket mounting plate 64 is coupled to. This may enable a game backboard wall protector 61 coupled to the game block device 22D to extend into the space between the game block device 22D and the vertical object, such as a wall 202, that the game and pole bracket 25B is coupled to.

In some embodiments, a game and pole bracket 25, 25A, 25B, may comprise a pole aperture 29 which may be sized to accept the mounting of a tether pole 45, optionally by inserting a portion of the tether pole 45 into the pole aperture 29 or optionally via a pole attachment device 48.

In further embodiments, a game and pole bracket 25, 25A, 25B, may comprise one or more bracket apertures 27 which may receive a fastener, such as a screw, bolt, rail, etc., that may be used to couple the game and pole bracket 25, 25A, 25B, to a vertical object, such as a wall 202, column, etc. Optionally, a game and pole bracket 25, 25A, 25B, may comprise one or more hang slots 28 that may be used to store tethered rings 31 when not in use by hanging them by their tethers 51 and/or apertures 32 in the hang slots 28. Hang slots 28 may be used as a safety feature by having the hang slots 28 positioned so that when the first end 52 of tethered ring 31 assemblies 35 are placed in these hang slots 28, the weight of the rings 31 will pull their tethers 51 taut and will raise them to a height above floor 201 level over the head heights of most people to safely walk in front of a game apparatus 100 when it is not in use.

Figure 14:
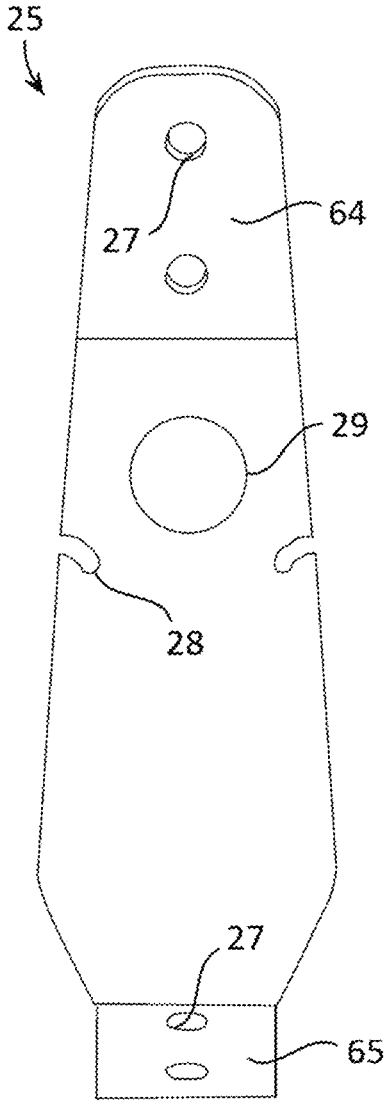
FIG. 14 illustrates a front elevation view of an example of a game and pole bracket according to various embodiments described herein.

Referring to FIGS. 14 and 15, an example of a game and pole bracket 25 is illustrated. Preferably, the game and pole bracket 25 may be shaped and angled in such a way that when attached to a game block device 22 a game apparatus 100 can be mounted to a wall 202 or vertical surface in the proper orientation as shown in the drawings. In some embodiments, a game and pole bracket 25 may comprise two bracket apertures 27 positioned vertically near the top end of game and pole bracket 25 that may be used to attach game apparatus 100 to a wall 202 or column using two screws or any other suitable coupling method. In further embodiments, a game and pole bracket 25 may comprise two bracket apertures 27 positioned vertically near the bottom end of game and pole bracket 25 that may be used to attach the game and pole bracket 25 to a game block device 22 as shown in the drawings. In further embodiments, a game and pole bracket 25 may comprise a pole aperture 29 or large hole for mounting optional pole proximal attachment device 48.

FIGS. 1-3 illustrate an example embodiment of the apparatus 100. In this and some embodiments, the apparatus 100 may include an optional game base board 21 coupled to a game block device 22A, and the target device 11 may be coupled to the game block device 22A. The game base board 21, game block device 22A, and/or the target device 11 may be coupled together with one or more fasteners 33, such as threaded fasteners that may include threaded inserts located in specific positions so that it will be in alignment with mounting holes on the game base board 21 and game block device 22A that may receive threaded bolts, screws, etc. In further embodiments, any other suitable coupling device or method may be used.

Figure 4:
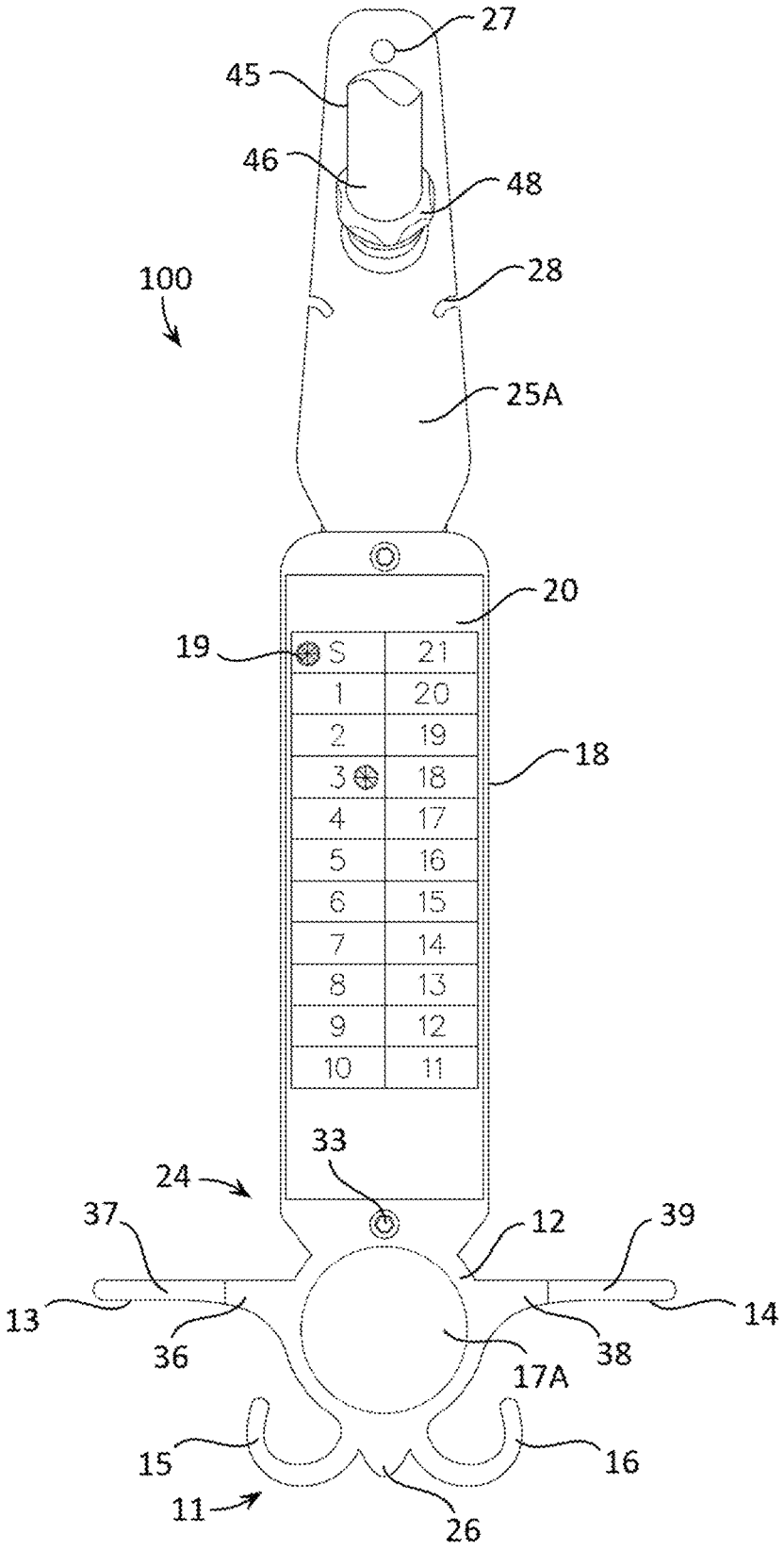
FIG. 4 depicts a front elevation view of another example of a tethered ring toss game apparatus according to various embodiments described herein.

FIGS. 4 and 5 show another example embodiment of the apparatus 100, showing another example of a game block device 22B coupled to a target device 11 (in this example, the target device 11 being part of a combination target and scoreboard device 24). The embodied game block device 22B made of wood, composite wood, plastic, aluminum or similar performing material and made to a specific shape, size and dimension to accept attachment of target device 11, a scoreboard device 18, and a game and pole bracket 25 in a specific position that make it possible and likely that the arc path 79 of a swinging overhead tethered ring 31 can engage targets 13, 14, 15, 16, during game play.

The combination target and scoreboard device 24 (target device 11 coupled directly to the scoreboard device 18) shown attached to game block device 22B is sized and shaped to provide two hook targets 15, 16, two bar targets 13, 14, and to allow for the emplacement of scoreboard graphics 20.

During game-play and for purpose of determining the scoring of points the hook targets 15, 16, of target device 11 coupled to the scoreboard device 18 are referred to as the "left hook" and the "right hook" and the slide bar targets of combination target and scoreboard device 24 are referred to as the "left slider bar" and the "right slider bar" as they pertain to their orientation to a player is facing the game apparatus. Also shown in FIG. 4 and FIG. 5 an example of multiplayer scoreboard graphics 20 consisting of the graphics necessary to track the score of multiple players by moving scoring score markers 19 from the scoring position graphically identified "S" (starting position) to scoring position graphically identified "21" or "F" (finishing and winning position). Multiplayer scoreboard graphics 20 graphics may comprise a printed label, be painted or applied directly on scoreboard device 18, or applied using any other suitable method. The score markers 19 (identified for each player) may be made of wood, plastic or other suitable material. These score markers 19 may be constructed to include an embedded magnet so it can be attached to any one of the twenty two (22) scoring positions on multiplayer scoreboard device 18.

Also shown in FIG. 4 and FIG. 5 an example of a game and pole bracket 25A attached to game block device 22B using galvanized, stainless or zinc plated steel bolts type fasteners 33. Furthermore, game and pole bracket 25, 25A, 25B, may have one or more, such as two, bracket apertures 27 that may be used to attach game and pole bracket 25, 25A, 25B, to a wall 202 or column using two screws or any other coupling method. Also, game and pole bracket 25, 25A, 25B, may include two hang slots 28 that may be used to store tethered ring assemblies 35 when not in use by hanging them by their tethers 51 in the slots 28. Also shown in FIG. 5 is game instruction graphic label 17B.

Figure 6:
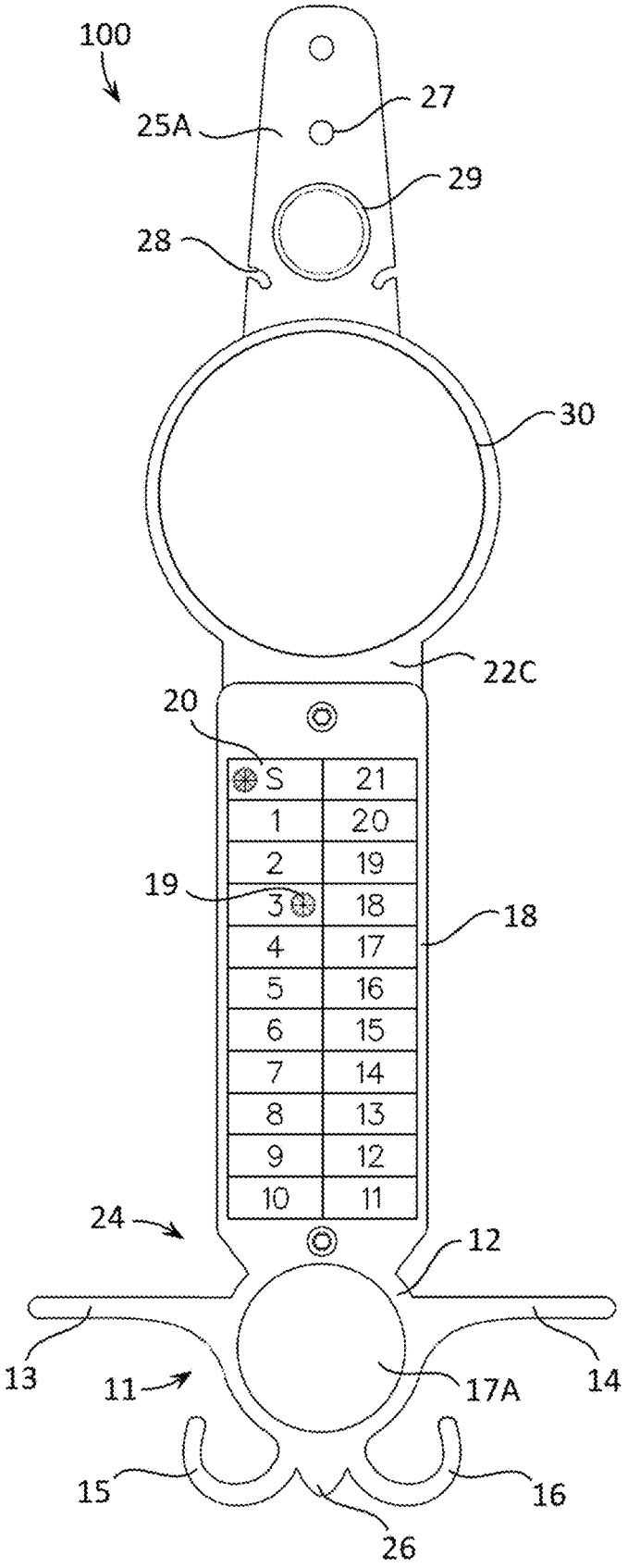
FIG. 6 shows a front elevation view of a further example of a tethered ring toss game apparatus according to various embodiments described herein.

Shown in FIG. 6 and FIG. 7 are the front and side views of another example embodiment of the game apparatus 100. Also shown in FIG. 6 and FIG. 7 is the embodied game block device 22C that may be made of wood, composite wood, plastic, aluminum or similar performing material and made to a specific shape, size and dimension to accept attached front baseboard 23 as shown in the drawings. Front baseboard 23 may be made of wood, composite wood, plastic, aluminum or similar performing material and made to a specific shape, size and dimension to allow for the attachment of combination target and scoreboard device 24. Front baseboard 23 may comprise a circular recessed area 30 to accommodate graphics label or a standard 4 inch drink coaster. One or more fasteners 33 positioned in specific locations to accommodate the attachment of front baseboard 23, combination target and scoreboard device 24 and game and game and pole bracket 25A as shown. The combination target and scoreboard device 24 shown attached to game block device 22C and front baseboard comprises two (2) hook targets 15, 16, and two (2) bar targets 13, 14. Further description of combination target and scoreboard device 24 is the same as previously described combination target and scoreboard device 24 above. Shown in FIG. 6 and FIG. 7 is multiplayer scoreboard device 18. Shown also is a blank cap 34 used to cover the large hole in game and pole bracket 25A when optional pole proximal attachment device 48 is not needed, such as due to overhead tether attachment device 41 being attached directly to a ceiling 203 as shown in FIG. 16.

Figure 8:
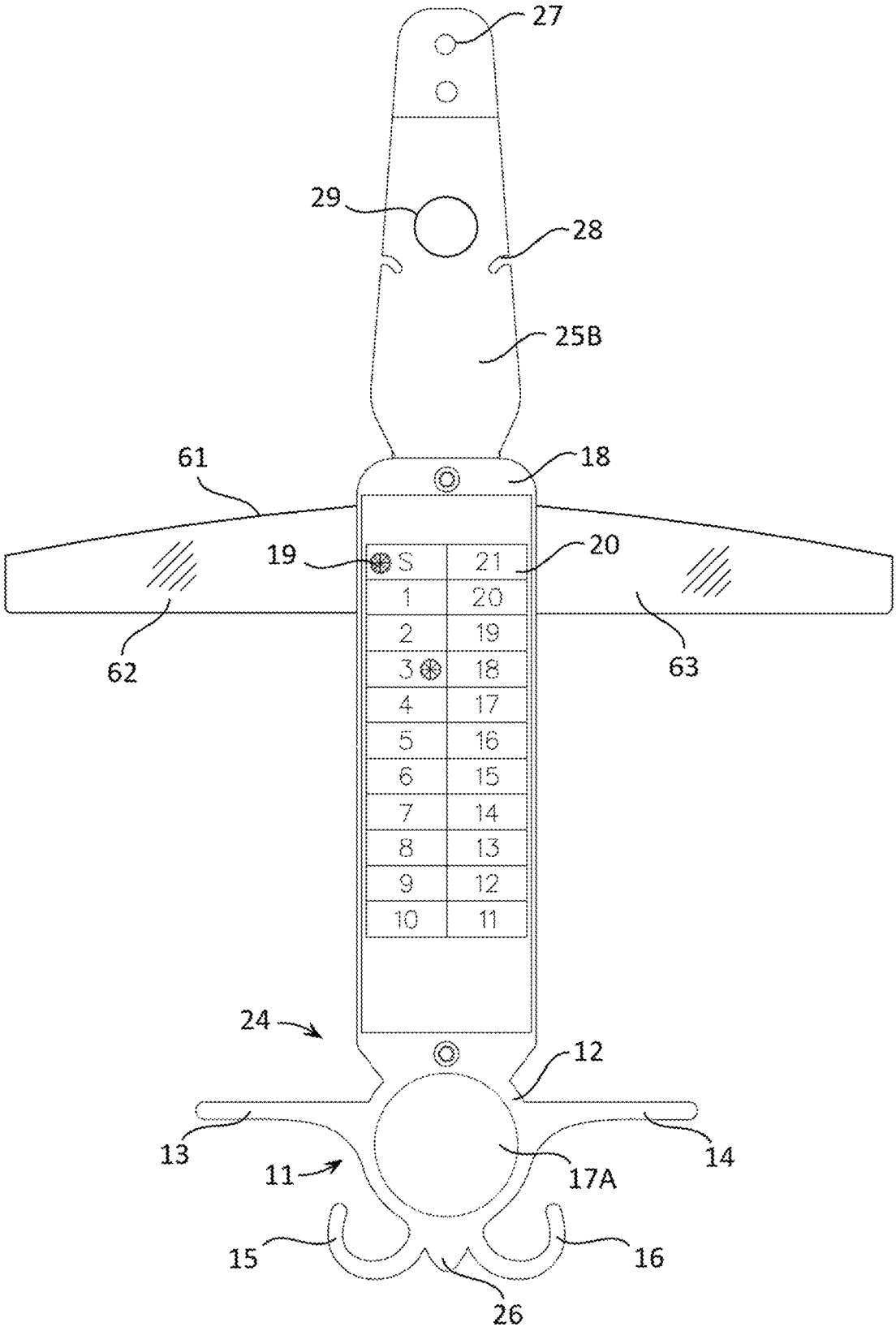
FIG. 8 illustrates a front elevation view of yet a further example of a tethered ring toss game apparatus according to various embodiments described herein.

Shown in FIG. 8 and FIG. 9 are front and side views of another example embodiment of the game apparatus 100. Shown in FIG. 8 and FIG. 9 is the embodied game block device 22D made of wood, composite wood, plastic, aluminum or similar performing material and made to a specific shape, size and dimension to accept attached combination target and scoreboard device 24 in a specific position that make it possible and likely that the arc path 79 of a swinging overhead tethered ring 31 can engage target devices 13, 14, 15, 16, during game play. Preferably, implemented within game block device 22D are pre-drilled holes in specific locations to accommodate the attachment of combination target and scoreboard device 24, game backboard-wall protector 61 and game and pole bracket 25B with mounting fasteners 33. The combination target and scoreboard device 24 shown attached to game block device 22D may be configured with two (2) hook targets 15, 16, two (2) bar targets 13, 14, and to allow the emplacement of scoreboard graphics 20.

Also shown in FIG. 8 and FIG. 9 is game and pole bracket 25B attached to game block device 6 using two galvanized, stainless or zinc plated screw type fasteners 33 as shown in above referenced drawings. Furthermore, game and pole bracket 25B may include two bracket apertures 27 that may be used to attach game and pole bracket 25B to a wall 202 or column using two screws or other fasteners 33 and has a large pole aperture 29 sized to accept the mounting of optional pole proximal attachment device 48 that may be used for the insertion of a sectional pole or a single length tether pole 45. Also shown is an example game and pole bracket 25B shaped and sized so that when used the target device 11 will be located the distance away from the wall 202 or other supporting structure providing the necessary clearance for a game backboard wall protector 61 to be used and function as described within.

Figure 10:
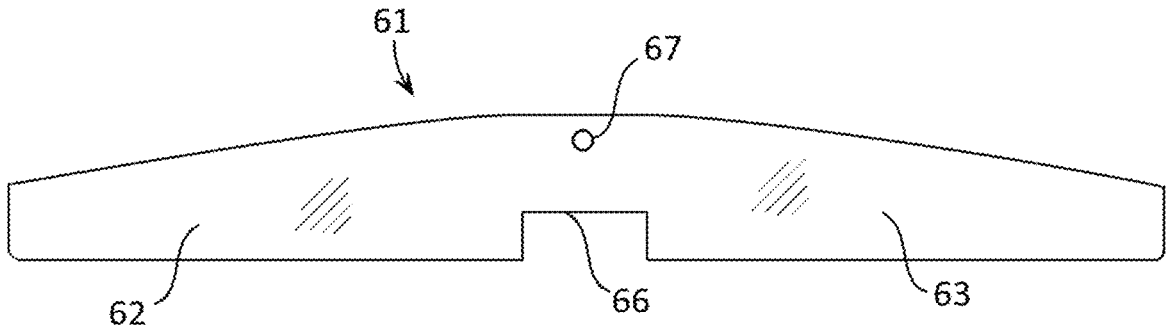
FIG. 10 depicts a perspective view of an example of a game backboard wall protector according to various embodiments described herein.

In some embodiments, the apparatus 100 may comprise a game backboard wall protector 61 as shown in FIGS. 8-10. A game backboard wall protector 61 may be made of or may comprise wood, composite wood, plastic, aluminum or similar performing material and is made to a specific shape, size and dimension so that when it is attached to a game block device 22 using a galvanized, stainless, zinc plated screw or other fastener 33 via a protector aperture 67, the game backboard wall protector 61 functions to deflect a tethered ring 31 in motion that has missed the game targets 13, 14, 15, 16, back towards the game targets 13, 14, 15, 16, thus increasing the chances that the deflected ring 31 will engage a target device 11 while at the same time preventing a deflected ring 31 from damaging walls 202 or vertical surface areas directly adjacent to game apparatus 100.

A game backboard wall protector 61 may be configured in any size and shape. Preferably, a game backboard wall protector 61 may comprise a first protector plate 62 and a second protector plate 63. In some embodiments, a first protector plate 62 may be positioned above the first hook target 15 and first bar target 13, and a second protector plate 63 may be positioned above the second hook target 16 and second bar target 14. In further embodiments, a game backboard wall protector 61 may comprise a protector recess 66 which may allow a portion of a game and pole bracket 25B to extend between protector plates 62, 63.

Figure 17:
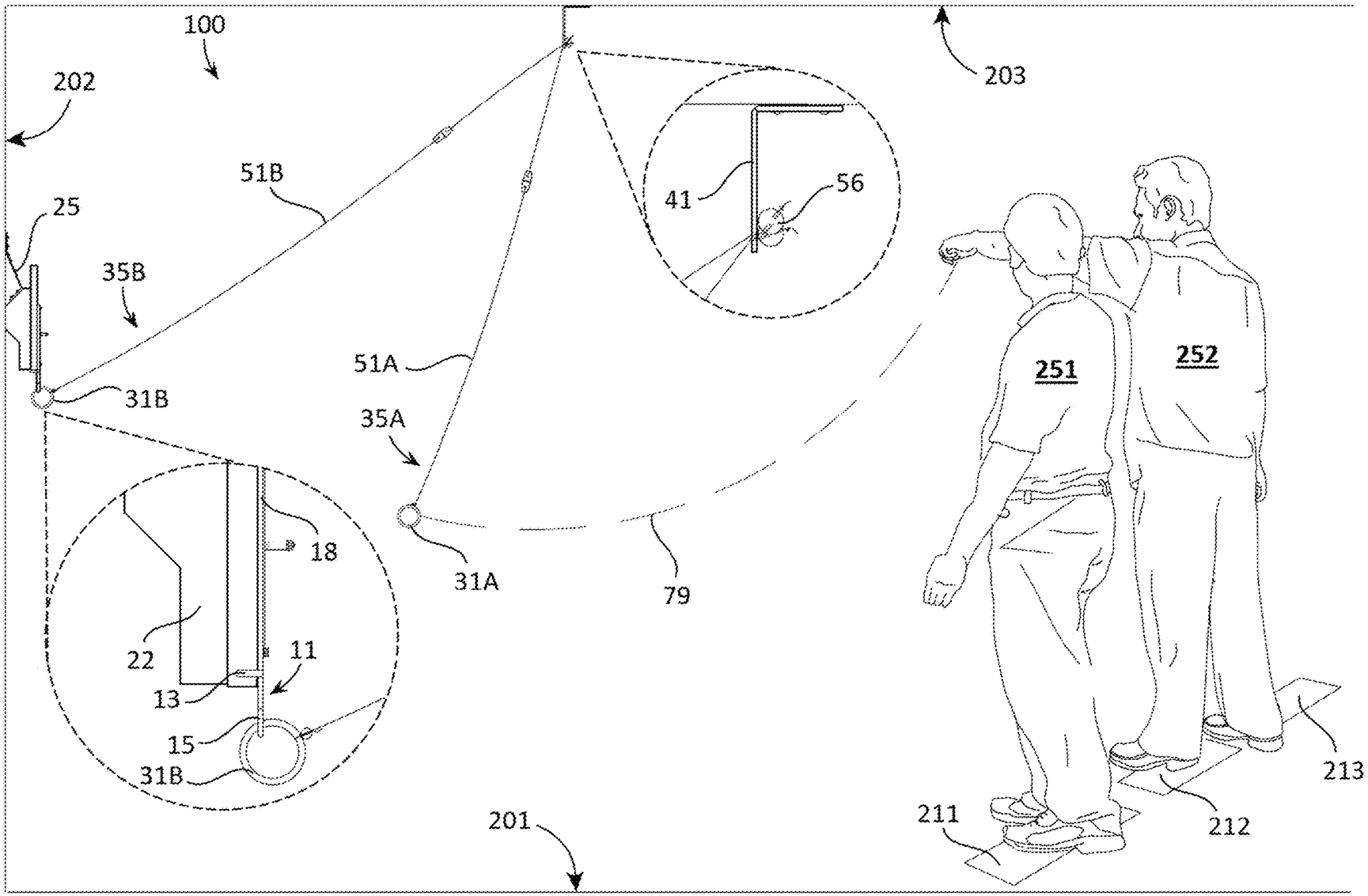
FIG. 17 illustrates an example of two players using a tethered ring toss game apparatus having two tethered ring device assemblies according to various embodiments described herein.

Turning now to FIG. 17, an example of an apparatus 100 being used by two users or players 251, 252, is shown. In reference to and in description of FIG. 17, this drawing depicts an example method of use for one embodiment of the apparatus 100. FIG. 17 shows two players 251, 252, each using one tethered ring device assembly 35A, 35B, during game play using a game apparatus 100 as embodied in FIGS. 6 and 7. The game play area and game apparatus 100 may be set up as shown in FIG. 17 and can be described as follows. The game apparatus 100 may be mounted with its targets 13, 14, 15, 16, approximately 60 inches above floor 201 on a wall 202. FIG. 17 further shows an overhead tether attachment device 41 mounted to ceiling 203 approximately 60 inches from wall 202. Continuing, FIG. 17 shows two (2) removable tethered ring device assemblies 35A, 35B, attached to tether attachment device 41. The length of each flexible tether 51 of each tethered assembly 35A, 35B, preferably may be adjusted using tethered ring locking bead device 55 (FIG. 16) so that it is possible and likely that the free-swinging arc path 79 of each tethered ring 31A, 31B, can engage target device 11. Tether attachment device 41 is configured and positioned to accept multiple removable tethered ring device assemblies 35 in such a way to keep tethers 51A, 51B, horizontally separated to reduce any impediments of their swinging motion and to prevent tangling. FIG. 17 shows first player 251 standing in On Deck Position 211 after tossing his tethered ring device 35B and second player 252 after just tossing his tethered ring device 35A with his ring 31A swinging in an arc path 79 toward the targets 13, 14, 15, 16. Further shown in FIG. 17 is two players 251, 252, standing next to each other at the distance opposite from the target device 11 where they can pull their flexible tethers 51A, 51B, taught thus enabling them to easily swing their rings 31A, 31B, towards the combination target and scoreboard device 24. The floor 201 may be marked to identify where each player 251, 252, stands during game play; one floor marking is centered and in direct line to target device 11 of apparatus 100; this is where a player stands 251, 252, when it's their turn to "swing" and is referred to as the Swing Position 212. On Deck Position 211 floor marking is shown to the left of Swing Position 212 and On Deck Position 213 is shown to the right, these on deck positions are where players 251, 252, may stand when not their turn and where they 'step back to' each time their turn ends.

To further describe the game play and method of use of the apparatus 100, FIG. 17 also shows an enlarged view of the tether attachment device 41 attached to ceiling 203 with two tethered ring assemblies 35A, 35B, attached. Additionally, FIG. 17 shows an enlarged view of the target device 11 during the game play showing the tossed ring 31A by first player 251 engaged with the left target hook 15 (a "left hook").

Figure 18:
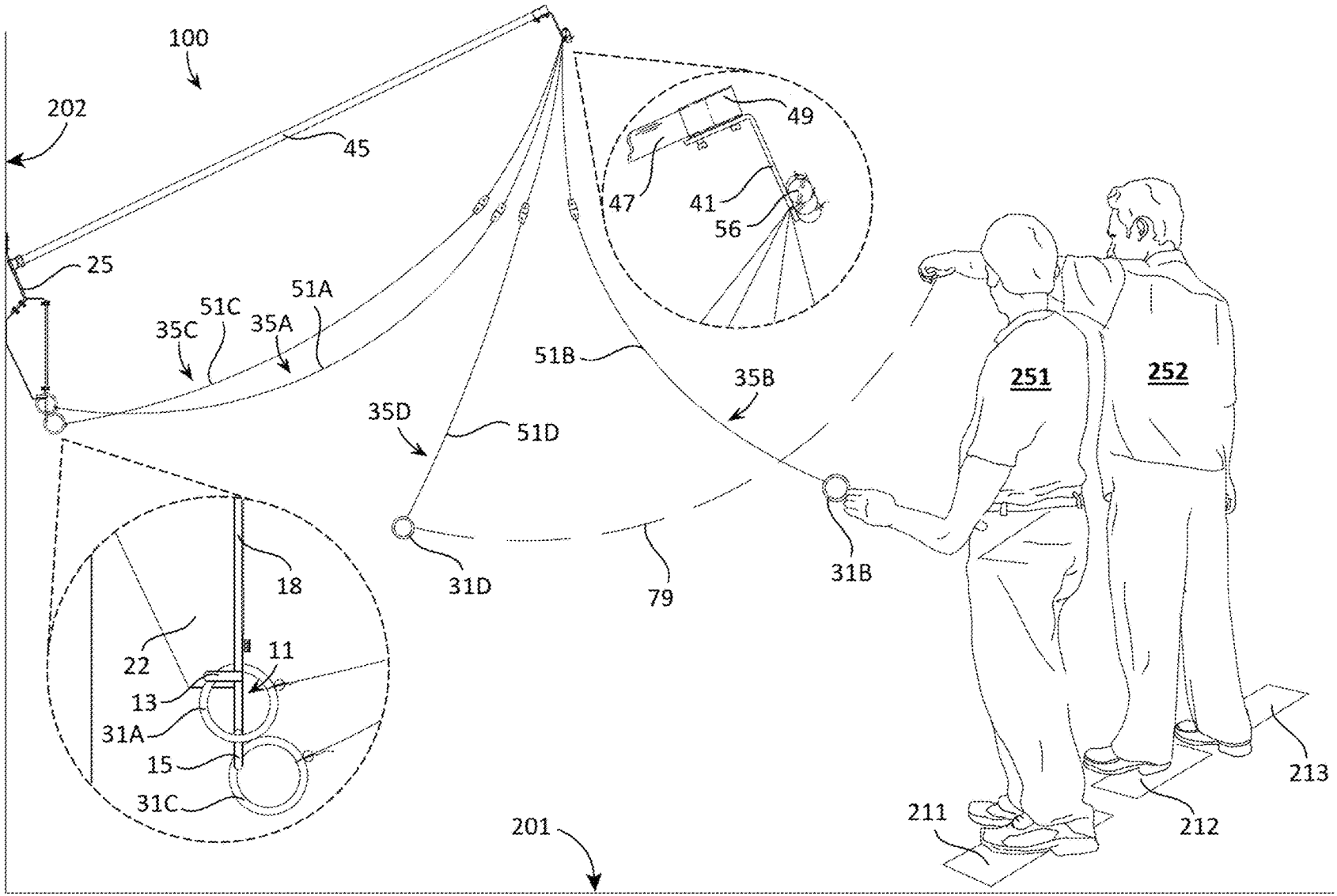
FIG. 18 shows an example of two players using a tethered ring toss game apparatus having four tethered ring device assemblies according to various embodiments described herein.

In reference to and in description of FIG. 18, this drawing depicts another method of use for the apparatus 100. FIG. 18 shows two players 251, 252, each using two tethered rings 31A, 31B, 31C, 31D, during game play. The game play area and game apparatus 100 set up shown in FIG. 18 can be described as follows. The target device 11 may be mounted with its targets 13, 14, 15, 16, approximately 60 inches above floor 201 on a wall 202. FIG. 18 further shows a 60 inch long tether pole 45 inserted in optional pole proximal attachment device 48. Also shown in FIG. 18 is tether attachment device 41 attached to pole distal attachment device 49 secured to top of tether pole 45. Continuing, FIG. 18 shows four (4) removable tethered ring device assemblies 35A, 35B, 35C, 35D, attached to tether attachment device 41. The length of each tethered assembly 35A, 35B, 35C, 35D, can be adjusted using tethered ring locking bead device 56 so that it is possible and likely that the free swinging arc path 79 of each tethered ring 31A, 31B, 31C, 31D, can engage targets 13, 14, 15, 16. FIG. 18 shows first player 251 standing on On Deck Position 211 floor marker holding his second tethered ring device 35B as he waits his turn and second player 252 standing on Swing Position 212 just after just tossing his second tethered ring device 35D with his ring 31D shown swinging in an arc path 79 toward the targets 13, 14, 15, 16. Also shown is On Deck Position 213 where second player 252 will 'step back to' after his turn ends.

To further describe the game play and method of use of the apparatus 100, FIG. 18 also shows an enlarged view of the elevated top end of the tether pole 45 and shows a close-up view of the overhead pivot attachment device 41 attached to pole distal attachment device 49 secured to top of tether pole 45. Also shown is all four tethered ring assemblies 35A, 35B, 35C, 35D, two for first player 251 and two for second player 252 attached to the tether attachment device 41.

FIG. 18 also shows an enlarged view of the target device 11 during the game play showing the first thrown ring 31A by first player 251 engaged with the left target slide bar 13 (a "left slider") and the first thrown ring 31C by second player 252 engaged with the left target hook 15 (a "left hook").

While some exemplary shapes and sizes have been provided for elements of the apparatus 100, it should be understood to one of ordinary skill in the art that the target device 11 tethered ring device assemblies 35, and any other element described herein may be configured in a plurality of sizes and shapes including "T" shaped, "X" shaped, square shaped, rectangular shaped, cylinder shaped, cuboid shaped, hexagonal prism shaped, triangular prism shaped, or any other geometric or non-geometric shape, including combinations of shapes. It is not intended herein to mention all the possible alternatives, equivalent forms or ramifications of the invention. It is understood that the terms and proposed shapes used herein are merely descriptive, rather than limiting, and that various changes, such as to size and shape, may be made without departing from the spirit or scope of the invention.

Additionally, while some materials have been provided, in other embodiments, the elements that comprise the apparatus 100 may be made from or may comprise durable materials such as aluminum, steel, other metals and metal alloys, wood, hard rubbers, hard plastics, fiber reinforced plastics, carbon fiber, fiber glass, resins, polymers or any other suitable materials including combinations of materials. Additionally, one or more elements may be made from or may comprise durable and slightly flexible materials such as soft plastics, silicone, soft rubbers, or any other suitable materials including combinations of materials. In some embodiments, one or more of the elements that comprise the apparatus 100 may be coupled or connected together with heat bonding, chemical bonding, adhesives, clasp type fasteners, clip type fasteners, rivet type fasteners, threaded type fasteners, other types of fasteners, or any other suitable joining method. In other embodiments, one or more of the elements that comprise the apparatus 100 may be coupled or removably connected by being press fit or snap fit together, by one or more fasteners such as hook and loop type or Velcro® fasteners, magnetic type fasteners, threaded type fasteners, sealable tongue and groove fasteners, snap fasteners, clip type fasteners, clasp type fasteners, ratchet type fasteners, a push-to-lock type connection method, a turn-to-lock type connection method, a slide-to-lock type connection method or any other suitable temporary connection method as one reasonably skilled in the art could envision to serve the same function. In further embodiments, one or more of the elements that comprise the apparatus 100 may be coupled by being one of connected to and integrally formed with another element of the apparatus 100.

Methods of Use and Game Play

Some of the most important aspects of the present invention is its new and novel playing methods and its interactive competitive game play for multiple players. The following sets forth the different scoring possibilities and their terminology during game play with two players 251, 252. The apparatus 100 may comprise a target device 11 having has two hook type targets 15, 16, on the bottom of the device one on the left and one on the right, for purpose of determining scoring; if ring 31 encircles and catches onto the left side target hook 15 it is referred to as a "left hook" and if ring 31 encircles and catches onto the right side target hook 16 it referred to as a "right hook", the term left and right as used above pertains to its orientation when a player 251, 252, is facing the game apparatus 100. A player 251, 252, will score 3 points for a left hook or right hook, however if both players 251, 252 ring device 31 encircle the same side (left or right) target hook 15, 16, during a round their point scores will cancel each other and no points are awarded. The target device 11 preferably has two slider bar targets 13, 14, located just above the hook targets 15, 16; one on the left side and one on the right side, for purpose of determining scoring; if ring 31 encircles and slides onto the left side target slide bar 13, it is referred to as a "left slider" and if ring 31 encircles and slides onto the right side of target slide bar 14, it is referred to as a "right slider", the term left and right as used above pertains to its orientation when a player 251, 252, is facing the game apparatus 100. A player 251, 252, will score 2 points for a left slider or right slider, however if both players 251, 252, ring device 31 encircles and slides onto the same side (left or right) of a target slide bar 13, 14, during a round their scores will cancel each other and no points are awarded. If ring 31 hangs from its tether 51 over the left target slide bar device 13, it is referred to as a "left hanger" and if ring 31 hangs from its tether 51 over the right target bar 14 it is referred to as a "right hanger", the term left and right as used above pertains to its orientation when a player 251, 252, is facing the game apparatus 100. A player 251, 252, will score 1 point for a "left hanger" or "right hanger", however if both players ring 31 hangs from its tether 51 over the same side (left or right) target slide bar 13, 14, during a round their scores will cancel each other and no points are awarded. To further describe game play scoring, a player 251, 252, can swing his tethered ring 31 and cause the removal of his opponent's ring 31 from a target device 11. Also, a player's ring 31 can engage a target bar 13, 14, in such a way that it blocks or impedes his opponent's ability to successfully engage a target hook 15, 16, with his ring 31.

The following is another preferred version of game play rules for apparatus 100. The game players 251, 252, can determine and decide who goes first to begin a game however they agree. As described above two players 251, 252, stand next to each other at the distance opposite from the game apparatus 100 where they can pull their flexible tethers 51 taut so as to easily swing their ring 31 towards the targets 13, 14, 15, 16, of the game apparatus 100. The player 251 going first steps to the "Swing Position" 212 and swings his tethered ring 31 toward the targets, if his ring 31 does not engage a target 13, 14, 15, 16, he catches his ring 31 as it 'swings back' and returns to his 'On deck position' 211, his opponent 252 then steps to the Swing Position 212 and swings his ring 31, this sequence continues until a player 'scores' on a target 13, 14, 15, 16, (a "Hook", a "Slider" or a "Hanger"); this 'score' begins the round; the scoring player steps back to his on deck position 211 and the other player gets one swing to occupy a different target 13, 14, 15, 16, than his opponent to score points, occupy the same target 13, 14, 15, 16, to cancel the scoring points of his opponent or to 'knock off' and remove his opponents ring 31 from a target device 11. Whatever the result of this last swing, it ends the round; at this time any scoring rings 31 can be retrieved by the players 251, 252, and their scores can be updated on the scoreboard 18. The player 251, 252, with the highest points in the round is next to swing to resume the game, as before the next round begins when a player 251, 252, scores a target 13, 14, 15, 16, and then ends after their opponent responds with one swing. A score of exactly 21 wins the game, if a player 251, 252, goes over 21 in a round no points are rewarded. If a player 251, 252, reaches exactly 21 points at the beginning of a round his opponent does gets one swing to 'knock off' his opponents ring 31 or cancel the scoring by occupying the same target 13, 14, 15, 16, to continue the game or occupy a different target 13, 14, 15, 16, that gets him 21 points which would end the game in a tie.

Other versions of game play rules for the apparatus 100 that supports interactive multiplayer competition can be used such as the scoring and rules of popular games of Horseshoes or Cornhole. Because of the apparatus includes multiple targets 13, 14, 15, 16, on the target device 11 other games can also be played; a game called "Around the World" usually played on a basketball court can be similarly played using the present invention game apparatus 100, the "shots" to be made in succession during this game play would be: "left hook", "left slider", "left hanger", "right hanger", "right slider" and finally "right hook" to win the game.

1. Although the present invention has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present invention, are contemplated thereby, and are intended to be covered by the following claims.

What is claimed is:

1. A tethered ring toss game apparatus, the apparatus comprising:

a target device having a target body, a first bar target, a second bar target, a first hook target, and a second hook target, wherein the first bar target and second bar target are positioned on opposite sides of the target body, wherein the first hook target and second hook target are positioned on opposite sides of the target body, wherein the first hook target and second hook target are planar in shape, and wherein the first hook target and second hook target are positioned in a vertical plane, wherein the first bar target comprises a first proximal section and the second bar target comprises a second proximal section, and wherein both the first proximal section and second proximal section are positioned in the vertical plane;

a ring having a ring aperture; and a flexible tether having a first end and a second end, wherein the ring is coupled to the first end, and wherein the second end is positioned above and in front of the target device, wherein the flexible tether comprises a length that enables the ring aperture of the ring to be alternatively positioned around each of the first bar target, second bar target, first hook target, and second hook target.

2. The apparatus of claim 1, wherein the first bar target comprises a first distal section and the second bar target comprises a second distal section, and wherein both the first distal section and second distal section extend out of the vertical plane.

3. The apparatus of claim 1, further comprising a scoreboard device coupled to the target body.

4. The apparatus of claim 3, further comprising a score marker that is magnetically coupled to the scoreboard device.

5. The apparatus of claim 1, wherein the flexible tether comprises a safety breakaway tether connector device.

6. The apparatus of claim 1, further comprising a game block device and a tether pole having a proximal end and a distal end, wherein the target device is coupled to the game block device, wherein the proximal end is coupled to the game block device, and wherein a tether attachment device is coupled to the distal end.

7. The apparatus of claim 1, further comprising a game backboard wall protector having a first protector plate and a second protector plate, wherein the first protector plate is positioned above the first hook target and first bar target, and wherein the second protector plate is positioned above the second hook target and second bar target.

8. The apparatus of claim 1, further comprising a tether attachment device configured to be coupled above the target device so that the tether attachment device is positioned above and in front of the target device, wherein the second end is coupled to the tether attachment device.

9. The apparatus of claim 8, wherein the second end of the flexible tether is removably coupled to the tether attachment device.

10. A tethered ring toss game apparatus, the apparatus comprising:

a target device having a target body, a first bar target, a second bar target, a first hook target, and a second hook target, wherein the first bar target and second bar target are positioned on opposite sides of the target body, wherein the first hook target and second hook target are positioned on opposite sides of the target body, wherein the first hook target and second hook target are planar in shape, and wherein the first hook target and second hook target are positioned in a vertical plane, wherein the first bar target comprises a first proximal section and the second bar target comprises a second proximal section, wherein both the first proximal section and second proximal section are positioned in the vertical plane, wherein the first bar target comprises a first distal section and the second bar target comprises a second distal section, and wherein both the first distal section and second distal section extend out of the vertical plane;

a ring having a ring aperture;

a tether attachment device configured to be coupled above the target device so that the tether attachment device is positioned above and in front of the target device; and a flexible tether having a first end and a second end, wherein the ring is coupled to the first end, and wherein the second end is coupled to the tether attachment device, wherein the flexible tether comprises a length that enables the ring aperture of the ring to be alternatively positioned around each of the first bar target, second bar target, first hook target, and second hook target.

11. The apparatus of claim 10, wherein the first bar target is positioned above the first hook target, and wherein the second bar target is positioned above the second hook target.

12. The apparatus of claim 10, further comprising a scoreboard device coupled to the target body.

13. The apparatus of claim 12, further comprising a score marker that is magnetically coupled to the scoreboard device.

14. The apparatus of claim 10, wherein the flexible tether comprises a safety breakaway tether connector device.

15. The apparatus of claim 10, further comprising a game block device and a tether pole having a proximal end and a distal end, wherein the target device is coupled to the game block device, wherein the proximal end is coupled to the game block device, and wherein the tether attachment device is coupled to the distal end.

16. The apparatus of claim 10, further comprising a game backboard wall protector having a first protector plate and a second protector plate, wherein the first protector plate is positioned above the first hook target and first bar target, and wherein the second protector plate is positioned above the second hook target and second bar target.

17. The apparatus of claim 10, wherein the second end of the flexible tether is removably coupled to the tether attachment device.

* * * * *